United States Patent [19]

Dufresne

[11] Patent Number: 4,576,430

[45] Date of Patent: Mar. 18, 1986

[54] SNAP CABLE CLAMP APPARATUS FOR BATTERY TERMINALS

[76] Inventor: Raymond A. Dufresne, 527 W. Townley, Phoenix, Ariz. 85021

[21] Appl. No.: 615,287

[22] Filed: May 30, 1984

[51] Int. Cl.[4] ..... H01R 11/26; H01R 11/11

[52] U.S. Cl. ..... 339/100; 339/116 C; 339/228; 339/238

[58] Field of Search ..... 339/238, 225, 116 R, 339/116 C, 100, 228

[56] References Cited

U.S. PATENT DOCUMENTS

| | | | |
|---|---|---|---|
| 3,867,007 | 2/1975 | Wening | 339/230 R |
| 4,372,636 | 2/1983 | Dufresne | 339/225 |
| 4,483,910 | 11/1984 | Julian | 339/116 R |

*Primary Examiner*—Gil Weidenfeld
*Assistant Examiner*—Paula A. Austin
*Attorney, Agent, or Firm*—H. Gordon Shields

[57] ABSTRACT

Snap cable clamp apparatus for battery terminals includes an elongated dielectric block with a conductive block embedded therein and an aperture extending through both blocks and a slot extending between the aperture and the end of the outer, dielectric block. The aperture is adapted to be disposed on a battery terminal post. A dielectric clamp extends over the dielectric block after the block has been secured to a battery terminal post to secure the block to the terminal post. The block and the clamp help to seal the terminal post to prevent corrosion from battery fumes building up on or between the terminal and the clamp apparatus.

13 Claims, 16 Drawing Figures

SNAP CABLE CLAMP APPARATUS FOR BATTERY TERMINALS

BACKGROUND OF THE INVENTION

1. Field of the Invention

This invention relates to battery terminal clamps and, more particularly, to battery terminal clamps for securing an electrical conductor to a battery terminal which utilizes a dielectric block generally covering the conductive portions of the clamp apparatus.

2. Description of the Prior Art

Battery terminals are generally a continuing source of potential problems in automotive and related applications. Acidic fumes given off by the battery result in corrosion building up on the battery, and particularly on the battery terminals. The positive terminal of batteries is generally the location at which the most corrosion builds up. Corrosion, to a lesser extent, builds on the negative battery terminal, also.

When corrosion builds up on a battery terminal to the extent that it interfers with the electrical contact between the battery terminal and the clamp or connector which electrically connects an electrical cable to a battery, a deterioration in the electrical system of the vehicle occurs. Ultimately, the deterioration results in a failure of the vehicle's electrical system. This is generally caused by an increase in resistance between the battery terminal and the attached cable and, ultimately, a cessation or breaking of electrical contact due to the corrosion.

There have been several prior art attempts to minimize the corrosion problem. One such attempt resulted in the movement of the battery terminals from the top of a battery to the side of a battery. This has had some positive effects, but it also has had some problems. It has, to some extent, solved part of the corrosion problem, since the battery fumes generally migrate across the top of the battery and outwardly, rather than downwardly. A major problem has been in the connecting of jumper cables to the side terminals.

Another attempt to solve the problem has been to use chemically impregnated washers on the battery terminals beneath the cable connectors. The chemicals in the washers, which are generally made of felt, chemically inhibit the formation of the corrosion by neutralizing the acidic gases as the gases emanate from the battery. However, over an extended period of time the chemical inhibitor is exhausted, and corrosion then builds up.

One of the simplest attempts to solve the corrosion problem is to coat the cable clamp and exposed portion of the battery terminal post with a relatively thick coating of grease. The grease acts as a protective coating which seals out the corrosive gas fumes from the battery. As in the other attempts to solve the problem, ultimately the grease wears away or is rubbed off, etc., and the terminal and clamp are then susceptible to the build-up of the corrosion. The grease poses other problems, too. The grease holds dust, dirt, and other particulates. The grease also easily rubs off on clothing, skin, etc., if a person inadvertently comes too close when the hood is open.

As discussed above, there are basically three approaches to the problem of battery corrosion, relocation of the terminals, use of a chemical corrosion inhibitor, as in the chemically impregnated felt washers, and a protective coating over the battery terminal and cable connector. None of the approaches is completely satisfactory for the reasons set forth. For a long time period solution, the chemical inhibitor and protective coatings have the same fundamental problem in that they ultimately wear out or lose their effect, leaving the battery cable and terminal open to the attack of the corrosive gases from the battery.

The battery side terminal situation is awkward, particularly in adapting the battery cables to the side terminal batteries, and also in utilizing the positive terminal of the battery for purposes of jumping batteries, when such is required. Moreover, a majority of batteries in vehicles currently use the top terminals rather than side terminals. The corrosion problem accordingly is a continuing problem.

Battery manufacturers themselves have taken another step in helping to solve the problem and in trying to develop a battery which lasts a maximum length of time. This has been accomplished by the design of different types of batteries, using different electrolytes, and by then "sealing" the battery. Rather than use the sulfuric acid which is and has been the most widely used electrolyte, new electrolytes have been developed, which allow a battery to be relatively maintenance free, since the addition of water is a minimum problem. Since a battery is "sealed", comparatively few of the acidic gases are vented from the battery. However, in batteries which require the addition of water on a periodic basis, the venting of the battery cells is the primary source of the corrosive gases. The latter batteries, which require the periodic addition of water, are still the most prevalent batteries available on the market today.

Another possible solution to the problem is illustrated in U.S. Pat. No. 4,372,636, dated February 8, 1983, the inventor of which is the inventor of the present apparatus. In the '636 apparatus, plastic caps are used to secure cables to battery terminals.

SUMMARY OF THE INVENTION

The invention described and claimed herein comprises a snap clamp for connecting a conductor or cable to a battery terminal, and the cable clamp apparatus includes a conductive block embedded in a dielectric block and with an aperture extending through the blocks which receives a battery terminal. A relatively long, lengthwise, slot extends between the aperture and the outer end of the dielectric block. The clamp includes flexible or elastic portions which provide an inward bias against the dielectric block.

Among the objects of the present invention are the following:

To provide new and useful apparatus for securing a conductor to a battery terminal;

To provide new and useful apparatus for securing a battery terminal to a cable utilizing a conductive block;

To provide new and useful apparatus for preventing corrosion between a battery terminal and an electrical cable connected to the battery terminal;

To provide new and useful apparatus for connecting a battery terminal to a cable utilizing a snap clamp; and To provide new and useful clamp apparatus for connecting a terminal post to an electrical conductor in which the clamp apparatus includes a conductive block connected to the conductor and embedded within a dielectric block.

DESCRIPTION OF THE PREFERRED EMBODIMENT

Figure 1:
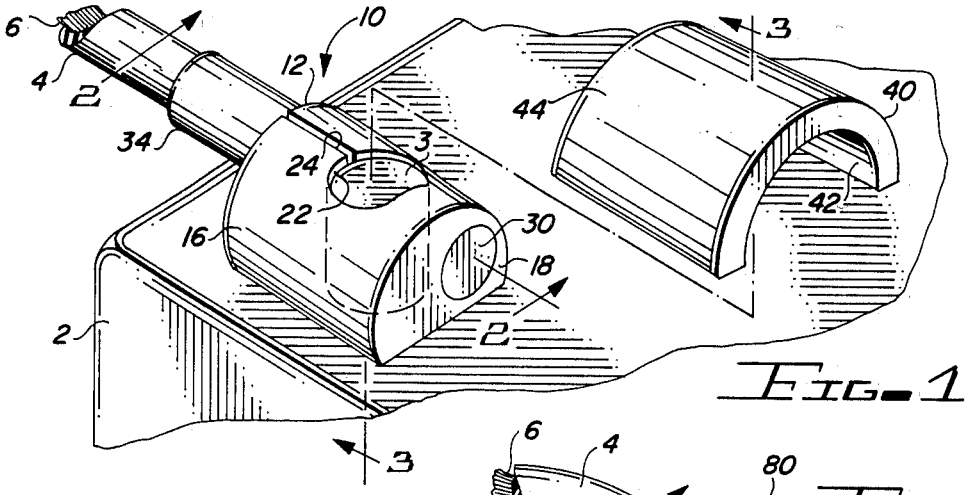
FIG. 1 is a perspective view of the apparatus of the present invention, with the two major portions shown separated apart.

FIG. 1 is a perspective view showing a portion of a battery 2, with battery clamp apparatus 10 of the present invention secured to a terminal post 3 extending upwardly from the top of the battery 2. The battery clamp apparatus 10 of the present invention includes two general portions, one portion comprises a dielectric block portion 12, and a conductive block 30 disposed within the dielectric block 12. The second portion is a snap clamping element 40 which is adapted to be disposed on top of the dielectric block 12 to secure the block 12 to the terminal post of the battery 2. The clamping element 40 is shown spaced apart from the dielectric block 12 in FIG. 1.

Figure 2:
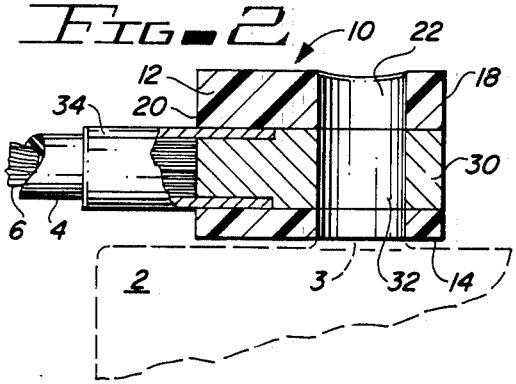
FIG. 2 is a view in partial section taken generally along line 2—2 of FIG. 1.
Figure 3:
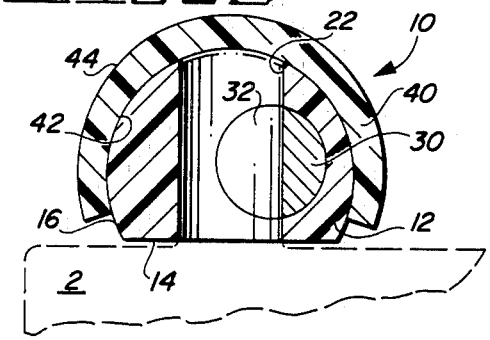
FIG. 3 is a view in partial section taken generally along line 3—3 of FIG. 1.
Figure 4:
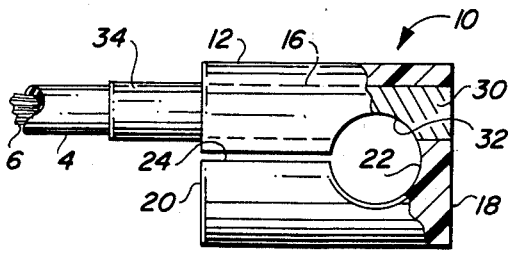
FIG. 4 is a top view, partially broken away, of a portion of the apparatus of FIG. 1.

FIG. 2 is a view in partial section through the dielectric block 12 and the conductive block 30, taken generally along line 2—2 of FIG. 1. FIG. 3 is a view in partial section of the dielectric block 12, the conductive block 30, and the snap clamping element 40, taken generally along line 3—3 of FIG. 1. FIG. 4 is a top view of the dielectric block 12, with a portion of the block 12 cut away, showing the conductive block 30. For the following discussion, reference will primarily be made to FIGS. 1, 2, 3, and 4 for the discussion of the snap cable clamp apparatus 10.

The battery 2 is shown in dotted line (phantom) in FIG. 2, with its terminal post 3, also shown in phantom, extending upwardly from the top or upper surface of the battery 2. The snap cable clamp apparatus 10 is adapted to secure a cable 4 to the terminal post 3 in a conductive relationship. The cable 4 includes a conductor 6 which is electrically connected to the battery terminal post 3 through the clamp apparatus 10.

The dielectric block 12 includes a generally flat bottom 14 which is adapted to bear against the top surface of the battery 2, or is adapted to be disposed relatively closely thereto, with the term "closely" simply meaning that it may come as close in proximity to the top of the battery 2 as is practical. In other words, the flat bottom surface 14 does not present any impediments or impairments to the securing of the clamp apparatus 10 to the battery terminal post 3.

The dielectric block 12 includes a curved side and top surface 16. As best shown in FIG. 3, the surface 16 is a continuous curve, comprising the outer portion of a cylinder cut by a flat plane, or the bottom surface 14. The angular extent of the surface 16 is greater than half of a cylinder, or greater than 180°, as may be seen from FIGS. 1 and 3.

The front and rear portions of the dielectric block 12 are defined by a flat front end 18 and a flat front end 20. The flat ends 18 and 20 are substantially perpendicular to the longitudinal axis of the dielectric block 12 and the bottom 14, and they are substantially parallel to each other.

Extending downwardly through the dielectric block 12 is a post aperture or bore 22. The post aperture or bore receives the terminal post 3 of the battery 2.

For convenience in securing the dielectric block 12 to a battery terminal post, there is a vertical expansion slot 24. The expansion slot 24 extends longitudinally in the dielectric block 12, and thus is generally parallel to or along the longitudinal axis of the dielectric block 12. The slot 24 extends completely through the dielectric block and thus communicates between the flat bottom 14 and the top or upper portion of the curved surface 16.

Within the dielectric block 12 is the conductive block 30. The conductive block 30 is appropriately electrically connected to the conductor 6. Extending through the conductive block 30 is an aperture portion 32 which comprises the conductive block portion of the aperture or bore 22 of the dielectric block 12. When the dielectric block 12 is disposed on a battery terminal post, with the post extending into the aperture or bore 22, the battery terminal post makes conductive contact, or electrical contact, with the aperture portion 32 of the conductive block 30.

For convenience in using jumper cables, a conductive sleeve 34 extends outwardly from the rear end 20 of the dielectric block 12. As shown in FIG. 2, the sleeve 34 is electrically connected to both the conductive block 30 and the conductor 6 of the cable 4. The jaws of a jumper cable clamp may be appropriately secured to the sleeve 34 for jumping purposes.

The clamping element 40 is made of a dielectric material, and it may be made of the same type of dielectric material, if desired, as the dielectric block 12 is made out of. The clamping element 40 includes a curved partial interior bore 42 and an exterior surface 44 which is generally parallel to the interior bore 42. The interior bore 42 is of cylindrical configuration, and it extends for a radial distance greater than 180°, as shown in FIG. 3. The partial bore 42 matingly fits on, or engages, the outer surface 16 of the dielectric block 12.

The clamping element 40 includes tension spring characteristics so that when it is placed on the outer surface 16 of the dielectric block 12, it exerts an inwardly directed bias on the dielectric block 12 to secure the block 12 to a battery terminal post. The width of the expansion slot 24 is minimized when the clamping element 40 is placed on the block 12. This assures a tight connection, electrically, between the battery terminal post and the conductive aperture or bore portion 32 of the conductive block 30.

It will be noted that the expansion slot 24 extends outwardly through the dielectric block 12 and remote from the conductive block 30. The exterior surface area of the conductive block 30 is accordingly minimized so far as access to corrosive gases is concerned.

While the clamping element 40 may be snapped downwardly into place on top of the dielectric block 12, the removal of the clamping element 40 is best accomplished by moving it longitudinally with respect to the dielectric block 12. Thus, the clamping element 40 may be slid, rather than pried, off the block 12. It will be noted that no tools are required to remove the clamping element 40, and also the block 12, from a battery terminal post. Similarly, no tools are required to install the clamp apparatus 10 to a battery. The use of pliers, screwdriver, and other special tools typically required for battery cable installation and removal are thus obviated.

Figure 5:
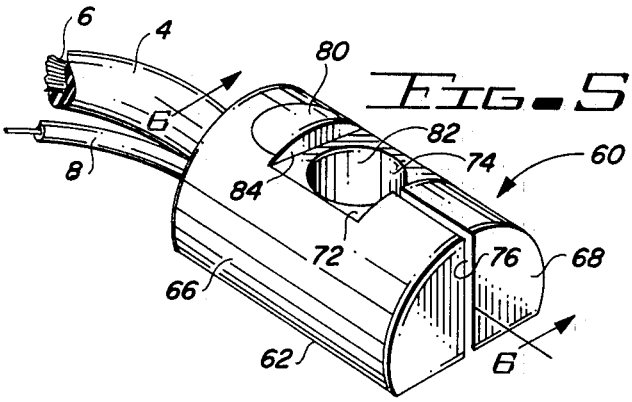
FIG. 5 is a perspective view of an alternate embodiment of the apparatus of the present invention.

FIG. 5 is a perspective view of an alternate embodiment of the clamp apparatus 10 of the present invention. The alternate embodiment shown in FIG. 5 comprises a clamp apparatus embodiment 60 which includes a dielectric block 62. The block 62 includes some structural differences from the dielectric block 12 of FIGS. 1–4 and of the conductive block 30 associated with the dielectric block 12.

Figure 6:
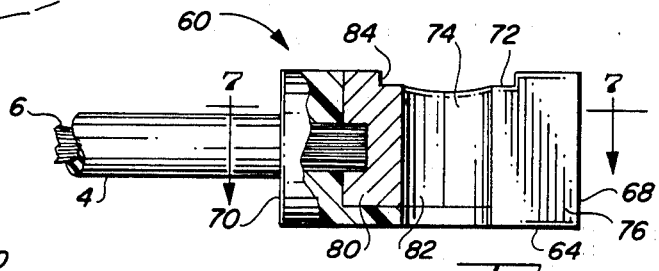
FIG. 6 is a view taken generally along line 6—6 of FIG. 5.
Figure 7:
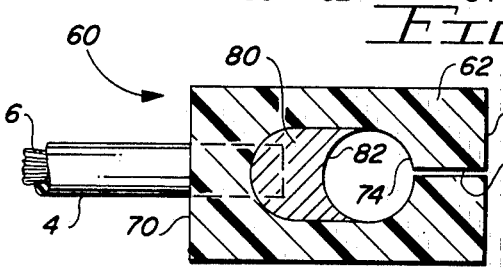
FIG. 7 is a view in partial section taken generally along line 7—7 of FIG. 6.

FIG. 6 is a view of the clamp apparatus 60 taken generally along line 6—6 of FIG. 5. FIG. 7 is a view in partial section of the apparatus 60 taken generally along line 7—7 of FIG. 6. For the following discussion concerning the snap cable clamp apparatus 60, reference will primarily be made to FIGS. 5, 6, and 7.

The cable clamp apparatus 60 includes a dielectric block 62 which is of the same general configuration as the dielectric block 12 of the clamp apparatus 10 of FIG. 1–4. The block 62 includes a flat bottom 64 and curved sides and top 66 extending upwardly from opposite sides of the bottom 64. A flat front end 68 and a flat rear end 70 of the block 62 are both substantially perpendicular to the flat bottom surface 64 and are generally parallel to each other.

A generally horizontal and relatively wide jumper slot 72 extends generally horizontally through the top of the dielectric block 62. The slot 72 is generally parallel to the flat bottom 64 and is disposed between the front end 68 and the rear end 70. Extending downwardly through the horizontal slot 72 is a post aperture or bore 74. Communicating with the post aperture 74, and extending from the post aperture 74 to the front end 68 is a vertically extending slot 76. The slot 76 is an expansion slot for convenience in installing the clamp apparatus 60 to a battery terminal post and in removing the clamp apparatus 60 from a terminal post.

Disposed within the dielectric block 62 is a conductive block 80. The conductive block 80 includes an aperture portion 82 which comprises the conductive portion of the post aperture 74 of the dielectric block 62. A jumper face or shoulder 84 comprises a conductive portion of the horizontal slot 72. The jumper face 84 may be used conveniently to secure a jumper cable clamp to the apparatus 60. Instead of utilizing a conductive sleeve, such as the sleeve 34 of the cable clamp apparatus 10, the jumper face 84 allows a jumper cable clamp to make electrical contact with a battery terminal post through the conductive block 80.

The conductor 6 of the battery cable 4 makes appropriate electrical connection with the conductive block 80, as best shown in FIG. 6. The insulative covering of the cable 4 is shown disposed against the rear end 70 of the block 62. The conductor 6 extends into the dielectric block 62 to make electrical contact with the conductive block 80. The conductor 6 is shown extending into a bore of the conductive block 80.

It will be noted that the vertical expansion slot 76 extends from the bore 74 to the front end or face 68 of the dielectric block 62, while the expansion slot 24 of the dielectric block 12 of the clamp apparatus 10 extends from the aperture or bore 22 rearwardly to the rear face 20 of the dielectric block 12. Obviously, the direction which the expansion slot extends is entirely immaterial. In the clamp apparatus 60 of FIGS. 5, 6, and 7, the slot 76 is generally centrally located, as is the connection of the cable 4 to the block 62. Thus, the cable 4 and the slot 76 are generally aligned. However, in the embodiment of FIGS. 1–4, the cable 4 is connected off center, or to one side of the block 12, while the expansion slot 24 is centrally located along the longitudinal axis of the block 12.

As is known and understood, there is sometimes an additional cable connected to a battery clamp. In FIG. 5, an accessory cable 8 is shown generally aligned with the cable 4. As is understood, the conductors of both the cable 4 and cable 8 make electrical contact with the conductive block 80.

The overall configuration and size of the clamp 60, and particularly the dielectric block 62, is substantially the same as that of the apparatus 10 of FIGS. 1–4. Thus the same clamping element 40 may be used with the dielectric block 62 of the alternate embodiment 60. The overall configuration of the dielectric block 60 is that of a generally truncated cylinder, with the truncation comprising the flat bottom 64 which extends generally parallel to the longitudinal axis of the block 62.

For using the jumper face 84 to connect a battery jumper cable, the clamping element 40 must be moved longitudinally away from the face 84 so as to provide access to the slot 72 and the face or shoulder 84. With the clamping element 40 covering the dielectric block 62, it will be noted that the battery terminal post and all conductive portions of the clamp apparatus 60 are covered, and thus are inaccessible to inadvertent touching or shorting. In the other embodiments disclosed herein, the major parts of the conductive portions of each clamp apparatus are also covered to prevent inadvertent touching or shorting. Only the jumper portion, either a sleeve or a block, is accessible in each embodiment. The dielectric block and the clamping element prevent short circuit from an inadvertent touch by a tool, etc., against the positive or "hot" terminal to which the clamp apparatus is secured.

If desired, a rubber or plastic sleeve (not shown) may be fitted on the conductive jumper sleeves to prevent shorts from inadvertent or accidental contact. Similarly, a rubber or plastic boot (not shown) may be placed over the jumper blocks for the same purpose. Such sleeves or boots may be easily removed when required.

Figure 8:
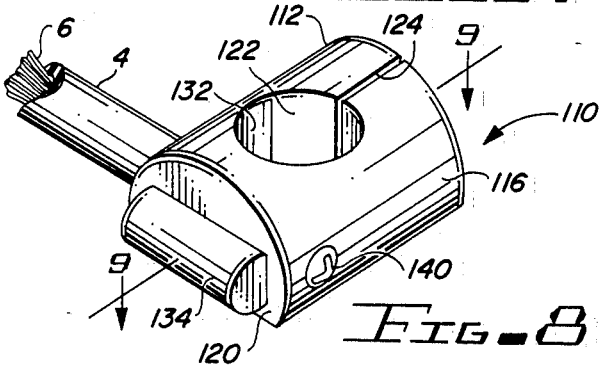
FIG. 8 is a perspective view of another alternate embodiment of the apparatus of the present invention.

FIG. 8 is a perspective view of an alternate clamp embodiment 110 of the apparatus of the present invention. The alternate clamp embodiment comprises a snap cable clamp apparatus 110 usable as an add-on or replacement clamp. The clamp apparatus 10 and the clamp apparatus 60 are both designed to be original equipment manufactured, with the dielectric blocks and their conductive blocks secured at the time of manufacture to electrical cables. The clamp apparatus 110 is designed to be a replacement clamp, and thus a user, after removing a cable's original clamp, may secure the clamp apparatus 110 to the preexisting cable. For convenience, the cable secured to the clamp apparatus 110 is illustrated as the cable 4 and its electrical conductor 6.

Figure 9:
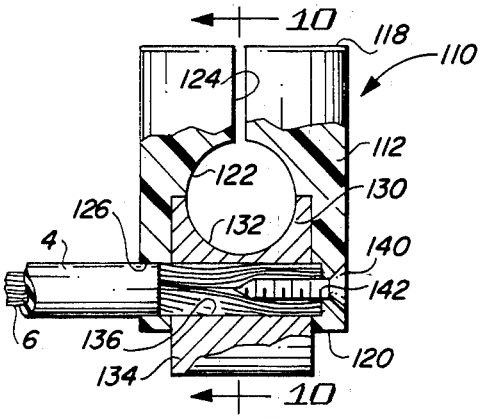
FIG. 9 is a view in partial section taken generally along line 9—9 of FIG. 8.
Figure 10:
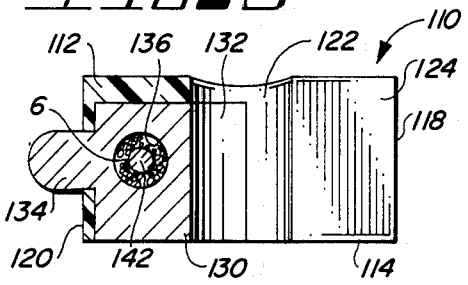
FIG. 10 is a view in partial section taken generally along line 10—10 of FIG. 9.

FIG. 9 is a view in partial section of the clamp apparatus 110 of FIG. 8, taken generally along line 9—9 of FIG. 8. FIG. 10 is a view in partial section of the clamp apparatus 110, taken generally along line 10—10 of FIG. 9. For the following discussion concerning the snap cable clamp apparatus 110, reference will primarily be made to FIGS. 8, 9, and 10.

The cable clamp apparatus 110 includes a dielectric block 112 which is generally of the same configuration as the blocks 12 and 62 of the clamp apparatuses 10 and 60, respectively. It is generally in the configuration of the truncated cylinder, with a flat bottom 64 and curved sides 66 extending between opposite edges of the flat bottom 64. The cylindrical configuration extends a radial distance greater than 180°, as with the dielectric blocks 12 and 62, discussed above.

The dielectric block 112 includes a flat front end 118 and a flat rear end 120, both of which are generally parallel to each other and both of which are generally perpendicular to the flat bottom 114. Extending downwardly through the block 112, generally centrally, or on a diametrical axis, between the flat bottom 114 and the top of the curved sides 116, is a post aperture or bore 122. A vertical slot 124 extends from the post aperture 122, through the block 112, to the front end 118. The vertical slot 124 is an expansion slot, substantially identical in purpose and configuration to the slots 24 and 76, respectively, of the clamps 10 and 60.

Within the dielectric block 112 is a conductive block 130. The conductive block 130 includes an aperture portion 132 which communicates with, and is thus the conductive portion of, the aperture or bore 122.

Extending outwardly from and through the rear end 120 is a jumper block 134. The jumper block 134 is for the convenience of securing the jaws of a jumper cable clamp to the clamp apparatus 110. The jumper block 134 is shown to be generally a rectangular or somewhat cylindrical protuberance portion of the conductive block 130 which extends outwardly from the end 120 of the dielectric block 112. The length of the jumper block 134 is generally perpendicular to the longitudinal axis of the block 112, and the block 134 thus extends in a side-to-side or transverse fashion, rather than axially, with respect to the dielectric block 112, as does the jumper sleeve 34 of the clamp apparatus 10.

It will also be noted that the cable 4 extends to the block 112 transversely, or from side to side, generally parallel to the length of the jumper block 134. Within the conductive block 130 is a transversely extending jumper cable bore 136. The bore 136 is aligned with a bore 126 in the dielectric block 112. The conductor 6 extends into the aligned bores 126 and 136 in the dielectric block 112 and the conductive block 130, respectively.

For securing the cable 4 to the apparatus 110, a screw 140 is used. The screw 140 extends through a screw aperture or hole in the dielectric block 112 and extends into the bore 136 of the conductive block 130. The screw 140 is used to provide an outward bias against the strands of the conductor 6 to urge the strands against the bore 136. The screw 140 includes a threaded shank 142 which applies the outward bias on the strands of the conductor 6. With the strands of the conductor 6 biased outwardly against the wall of the bore 136, the cable 4 is secured conductively to, or in electrical contact with, the conductive block 130.

A distinction between the clamp apparatus 110 and the two clamp embodiments 10 and 60, in addition to the other differences discussed above, is that a screwdriver, or the like, is required to secure the cable 4 to the clamp apparatus 110. However, once the screw 140 is securely anchored to the strands of the conductor 6, no further tools are required to either install or remove the clamp apparatus 110 from or to a terminal post. Thus, the clamp apparatus 110 is substantially the same in operation and use as the clamp apparatus 10 and 60, discussed above, once a cable 4 is secured to the clamp apparatus 110.

As with the clamp apparatus 10 and the clamp apparatus 60 discussed above, the clamping element 40 fits on the block 112 to secure the block 112, and accordingly the conductive block 130 and the cable 4, to a battery terminal post.

Figure 11:
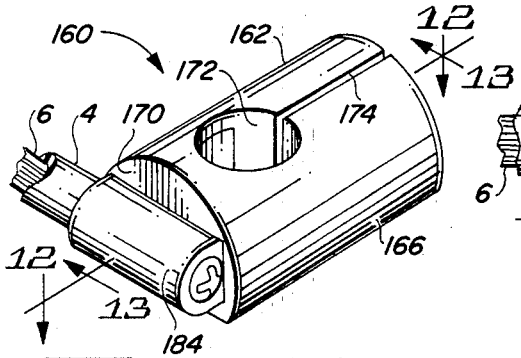
FIG. 11 is a perspective view of another alternate embodiment of the apparatus of the present invention.

FIG. 11 is a perspective view of another alternate embodiment of the apparatus of the present invention, comprising a clamp apparatus 160. The clamp apparatus 160 is similar to the clamp apparatus 110 in that it is an add-on or replacement clamp. Also, the cable 4 is secured to the clamp apparatus 160 from the side, or transversely, as with the clamp apparatus 110, rather than being axially aligned, as with the clamp apparatus 10 and the clamp apparatus 60.

Figure 13:
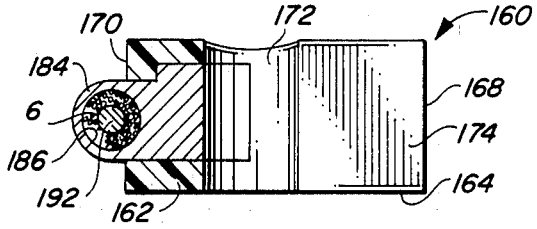
FIG. 13 is a view in partial section taken generally along line 13—13 of FIG. 11.
Figure 12:
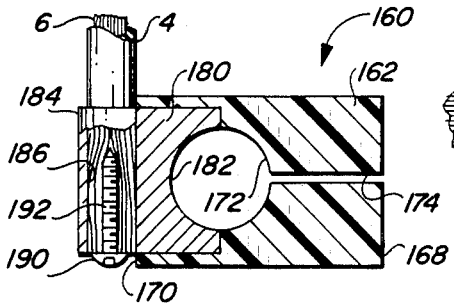
FIG. 12 is a view in partial section taken generally along line 12—12 of FIG. 11.

FIG. 12 is a view in partial section of the clamp apparatus 160, taken generally along line 12—12 of FIG. 11. FIG. 13 is a view in partial section of the clamp apparatus 160 taken generally along line 13—13 of FIG. 11. For the following discussion concerning the clamp apparatus 160, reference will primarily be made to FIGS. 11, 12, and 13.

The clamp apparatus 160 includes a dielectric block 162, which is of substantially the same configuration as the dielectric block 112. Included within the dielectric block 162 is a conductive block 180 which has an exteriorally disposed jumper block 184. The jumper block 184 is substantially the same as the jumper block 134 of the conductive block 130, as discussed above for the clamp apparatus 110. However, the manner in which the cable 4 is secured to the clamp apparatus 160 is different from the manner in which the cable 4 is secured to the clamp apparatus 110.

The dielectric block 162 is substantially identical to the dielectric block 130, discussed above, namely cylindrical in configuration and truncated along its longitudinal axis. It includes a generally flat or planar bottom 164, with curved sides 166 extending upwardly from the opposite edges of the flat bottom 164. The extent of the cylindrically curved sides 66, angularly speaking, is greater than 180°, as has been discussed above for the other dielectric blocks.

At the front end of the dielectric block 162 is a front end or face 168, and at the rear end of the block 162 is a rear end or face 170. The front end 168 and the rear end 170 are substantially parallel to each other, and they are substantially perpendicular to the flat bottom 164.

Extending downwardly through the dielectric block 162 is a post aperture or bore 172. The post aperture bore 172 is centrally located, as on a diameter of the block 162, and is substantially perpendicular to the longitudinal axis of the block 162.

A vertical slot 174, for expansion purposes, extends from the bore 172 outwardly to the front face 168. The slot 174 is for the purpose of expanding the dielectric block 162 to allow the bore 172 to receive a battery terminal post. This has been discussed above in conjunction with all of the other embodiments.

Within the dielectric block 162 is the conductive block 180. The conductive block 180 includes a relieved portion or aperture portion 182 which is coextensive with a portion of the bore 172 of the dielectric block 162. The aperture or bore portion 182 makes conductive or electrical contact with the battery terminal post to which the clamp 160 is secured.

Extending outwardly from the end face 170 is the jumper block 184. The jumper block 184 is substantially identical to the jumper block 134, discussed above in conjunction with the embodiment of FIGS. 8, 9, and 10.

The jumper block 184 includes a conductor or cable bore 186 extending through the jumper block 184. Conductive strands 6 of the cable 4 extend into the bore 186. For holding the strands 6 in the bore 186, a screw 190 is used. The screw 190 includes a threaded shank 192 which extends into the strands 6 and biases them outwardly against the bore 186 to secure the jumper cable 4 to the jumper block 184 and thus to the conductive block 180 and the clamp apparatus 160.

It will be noted that the clamp 160, as shown in FIGS. 11, 12, and 13, differs from the clamp apparatus 110 in that the cable 4 is secured to the jumper block 184 in the clamp apparatus 160, as opposed to the cable 4 being connected directly to the conductive block 130 within the dielectric block 112, as in the embodiment of clamp 110 of FIGS. 8, 9, and 10. In both embodiments, screws are used to secure the cables to the clamps. Both clamp embodiments 110 and 160 are for add-on purposes, or after market purposes, as opposed to original equipment manufactured clamp apparatus.

It will also be noted that for the clamp apparatus 110 and the clamp apparatus 160, a screwdriver is needed initially to secure the clamp apparatus to a cable. However, in all of the embodiments of the apparatus of the present invention, no special equipment or tools are required to secure the clamp to a terminal post or to remove the clamp from a terminal post. Rather, the installation and removal is simply accomplished by hand. For installation, the clamp apparatus is fitted onto a terminal post, and a holding or locking clamp, such as the clamping element 40, is snapped in place onto a dielectric block to hold the dielectric block, and thus the conductive block within the dielectric block, in electrical contact with a battery terminal post. For removal, the holding or locking clamp or clamping element is moved manually along the axis of the dielectric block to remove the clamping element from the dielectric block. The dielectric block is then removed from the battery terminal post.

Figure 14:
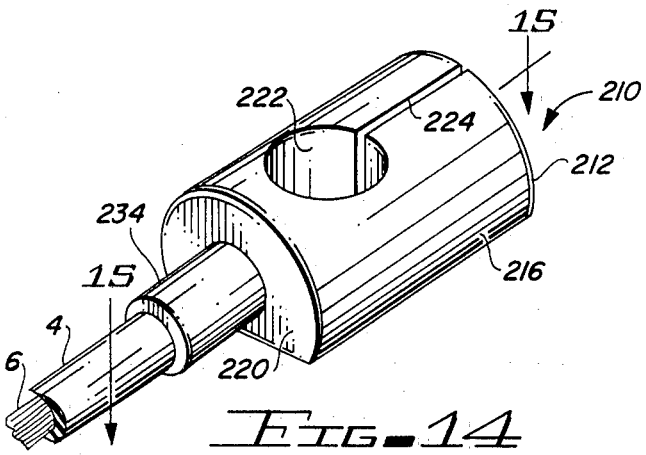
FIG. 14 is a perspective view of another alternate embodiment of the apparatus of the present invention.

FIG. 14 is a perspective view of clamp apparatus 210, which comprises another alternate embodiment of the apparatus of the present invention. The clamp apparatus 210 is also an add-on type clamp, or an after market clamp, like the clamp apparatus 110 and 160, as opposed to an original equipment type clamp apparatus, like the apparatus 10 and 60. As an add-on clamp, the clamp apparatus 210 varies from the clamp apparatus 110 and 160 primarily in the securing of a cable to the clamp apparatus.

Figure 15:
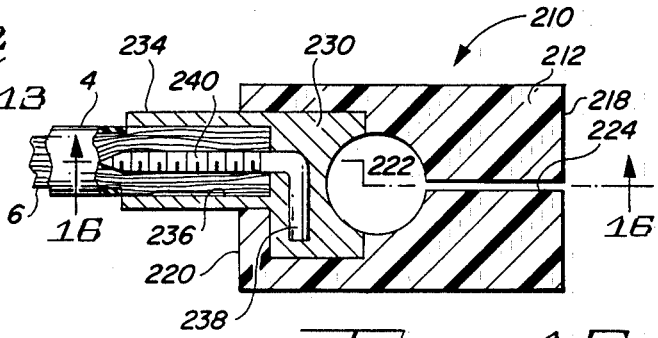
FIG. 15 is a view in partial section taken generally along line 15—15 of FIG. 14.
Figure 16:
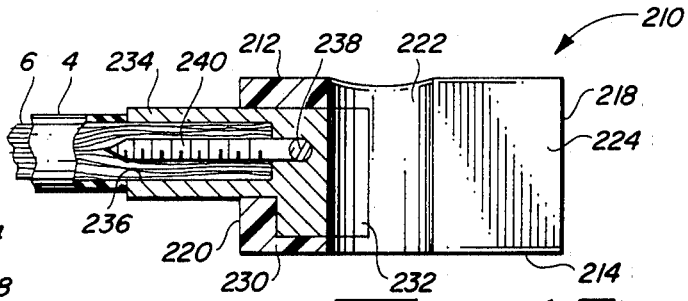
FIG. 16 is a view in partial section taken generally along line 16—16 of FIG. 15.

FIG. 15 is a view in partial section of the clamp apparatus 210, taken generally along line 15—15 of FIG. 14. FIG. 16 is a view in partial section of the clamp apparatus 210 taken generally along line 16—16 of FIG. 15. For the following discussion of the clamp apparatus 210, reference will primarily be made to FIGS. 14, 15, and 16.

The clamp apparatus 210 includes a dielectric block 212, which is similar to the dielectric blocks discussed above in conjunction with the other embodiments of the present invention. The dielectric block 212 includes a flat bottom 214 with curved outer portions or sides 216 extending upwardly and downwardly between opposite edges of the flat bottom 214. The dielectric block 212 includes a generally flat front end or face 218 and a generally flat rear end or face 220. The ends 218 and 220 are substantially parallel to each other and substantially perpendicular to the flat bottom 214. The curved side 216 extends an angular distance greater than 180°, as discussed above in conjunction with the other dielectric blocks.

Extending downwardly through the dielectric block 212 is a terminal post aperture or bore 222. The bore 222 is preferably on a diameter of the block 212, and thus extends through the block 212 a maximum distance. The block 212, as has been discussed above, is preferably in the configuration of a truncated cylinder, with the truncation taken along the flat bottom 214, and thus generally parallel to the longitudinal axis of the block 212.

A vertical expansion slot 224 extends from the bore 222 outwardly to the front end 218. The purpose of the slot 224 is substantially the same as for the other expansion slots discussed above in conjunction with the other embodiments.

Within the dielectric block 212 is a conductive block 230. The conductive block 230 includes a relieved portion or bore portion 232. The bore portion 232 is substantially coextensive with part of the post aperture or bore 222. The aperture or bore portion 232 comprises the conductive portion of the clamp apparatus 210 which makes electrical contact with a terminal post.

Extending outwardly from the rear face 220 of the dielectric block 212 is a jumper sleeve 234. The jumper sleeve 234 is a continuation of, or is electrically connected to, the conductive block 230. The sleeve 234 is for purposes of fastening the jaws of a jumper cable to the clamp apparatus 210.

The sleeve 234 includes a cable bore 236. The cable bore 236 receives the strands 6 of a cable 4 for purposes of connecting the cable 4 to the clamp 210.

Embedded within the conductive block 230 is a screw 238. The screw 238 includes a threaded shank 240. The shank 240 of the screw 238 is disposed coaxially within the cable bore 236. The shank 240 of the screw 238 is used to bias the conductive strands 6 of the cable 4 outwardly against the bore 236 to secure the cable 4 to the clamp apparatus 210.

In operation, the insulation on the exterior of the cable 4 is cut away to expose the strands 6. The exposed portions of the strands 6 are then inserted into the bore 236. The cable 4 is then literally screwed into the bore 236 by rotating either the cable 4 or the clamp apparatus 210. Obviously, it is probably easier to rotate the clamp apparatus 210 and hold the cable 4 still, rather than vice versa. The relative rotational movement between the cable 4 and the clamp apparatus 210 causes the threaded shank 240 of the screw 238 to become effective in biasing the strands of the conductor 6 outwardly against the bore 236. In this manner,the cable 4 is securely attached to the clamp apparatus 210.

It will be noted that by embedding the screw 238 in the conductive block 230, no tools are required to secure the cable 4 to the clamp apparatus 210. The use of a separate screw, such as the screw 140 or the screw 190, for the clamp apparatus 110 and the clamp apparatus 160, respectively, is obviated. Moreover, with the clamp apparatus 210, the cable 4 is secured in general alignment with the longitudinal axis of the clamp apparatus. For the clamp apparatus 110 and the clamp apparatus 160, the cable 4 is attached generally perpendicularly to, or transversely of, the longitudinal axis of the respective clamp apparatus. There are, of course, advantages and disadvantages in each particular style. Obviously, a screw, such as the screw 238, may also be embedded with the conductive blocks 130 and 180, if desired, so that the threaded shank portions of the screws may extend into the conductive cable bores of the respective clamps 110 and 160, if desired. Thus, the advantages of the sideways or transverse connection of the cables to the clamps is retained, but the requirement of using a separate screw, and thus a screwdriver, is obviated.

As has been indicated, the general configuration of all of the dielectric blocks of the clamp apparatus discussed herein is substantially the same, and each includes an angular or radial distance somewhat greater than 180° for purposes of securing the clamping or holding element, such as the clamping element 40, to the exterior of the dielectric blocks. Each embodiment includes an expansion slot which extends generally vertically from the flat bottom of the dielectric block, and the expansion slots are generally diametrically aligned with the longitudinal axis of the bores which receive the terminal posts. When the holding clamp is applied to the dielectric block, a uniform clamping force is applied throughout the vertical height (or diameter) of the dielectric block and thus along the vertical length of a terminal post to which a clamp apparatus is secured.

While the principles of the invention have been made clear in illustrative embodiments, there will be immediately obvious to those skilled in the art many modifications of structure, arrangement, proportions, the elements, materials, and cqmponents used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Cable clamp apparatus for connecting an electrical cable to a terminal post, comprising, in combination:

dielectric block means, including a dielectric block, a bore in the dielectric block for receiving the terminal post, and an expansion slot extending through the dielectric block, a relieved portion communicating with the bore in the dielectric block for providing electrical contact with the terminal post, means for electrically connecting the conductive block to the electrical cable, and means for connecting a jumper cable to the conductive block including a jumper face on the conductive block; and clamping means disposed on the dielectric block for securing the dielectric block to the terminal post.

2. The apparatus of claim 1 in which the means for connecting a jumper cable to the conductive block includes a conductive sleeve disposed about the electrical cable and electrically connected to the conductive block.

3. The apparatus of claim 1 in which the means for connecting a jumper cable to the conductive block in includes a conductive jumper block extending outwardly from the dielectric block and electrically connected to the conductive block and adapted to be connected to the jaws of a jumper cable clamp.

4. The apparatus of claim 1 in which the means for connecting a jumper cable to the conductive block further includes a jumper slot extending across the dielectric block and the conductive block, and the jumper face comprises a conductive portion of the jumper slot.

5. The apparatus of claim 1 in which the dielectric block includes a curved outer surface, and the clamp means is disposed on the curved outer surface.

6. The apparatus of claim 5 in which the curved outer surface is generally cylindrical, and the clamping means includes a cylindrically curved interior bore portion which matingly engages the generally cylindrical curved outer surface of the dielectric block.

7. The apparatus of claim 6 in which the generally cylindrical outer surface of the dielectric block extends for a radial distance greater than 180°.

8. The apparatus of claim 1 in which the means for electrically connecting the conductive block means to the electrical cable includes a conductor cable bore in the conductive block means for receiving the electrical cable.

9. The apparatus of claim 8 in which the means for electrically connecting the conductive block means to the electrical cable further includes screw means for biasing the electrical cable in the conductor cable bore for securing the cable to the conductive block means.

10. The apparatus of claim 9 in which the dielectric block means further includes a first bore aligned with the conductor cable bore for receiving the electrical cable.

11. The apparatus of claim 9 in which the conductive block means further includes a jumper block extending outwardly from the dielectric block means, and the conductor cable bore is disposed in the jumper block.

12. The apparatus of claim 9 in which the conductive block means includes a jumper sleeve extending outwardly from the dielectric block means, and the conductor cable bore is disposed in the jumper sleeve.

13. The apparatus of claim 12 in which the screw means is disposed in the conductive block means and in the conductor cable bore.

* * * * *